United States Patent [19]

Uemura et al.

[11] Patent Number: 4,656,022

[45] Date of Patent: Apr. 7, 1987

[54] PROCESS FOR PRODUCING PITCH CARBON FIBERS

[75] Inventors: Seiichi Uemura, Tokyo; Takao Hirose, Kamakura; Yoshio Sohda, Kawasaki; Takayoshi Sakamoto, Hiratsuka; Kenji Katoh, Kawasaki, all of Japan

[73] Assignee: Nippon Oil Company, Limited, Japan

[21] Appl. No.: 820,431

[22] Filed: Jan. 17, 1986

[30] Foreign Application Priority Data

Jan. 18, 1985 [JP] Japan ..... 60-5851

[51] Int. Cl.[4] ..... D01C 5/08; D01F 9/12

[52] U.S. Cl. ..... 423/447.2; 423/447.4; 423/447.6; 264/29.2

[58] Field of Search ..... 264/29.2; 423/447.2, 423/447.4, 447.6

[56] References Cited

U.S. PATENT DOCUMENTS

| | | | |
|---|---|---|---|
| 3,552,922 | 1/1971 | Ishikawa et al. | 423/447.4 |
| 4,009,248 | 2/1977 | Kishimoto et al. | 423/447.6 |
| 4,259,307 | 3/1981 | Marayama | 423/447.6 |
| 4,460,557 | 7/1984 | Takashima et al. | 423/447.4 |

FOREIGN PATENT DOCUMENTS

| | | | |
|---|---|---|---|
| 54-134126 | 10/1979 | Japan | 264/29.2 |
| 59-199872 | 11/1984 | Japan | 264/29.2 |
| 59-223315 | 12/1984 | Japan | 264/29.2 |
| 60-88124 | 5/1985 | Japan | 264/29.2 |

*Primary Examiner*—John Doll
*Assistant Examiner*—Robert M. Kunemund
*Attorney, Agent, or Firm*—Scully, Scott, Murphy & Presser

[57] ABSTRACT

In the process for producing pitch carbon fibers by melt-spinning a carbonaceous pitch, and infusiblizing the resulting pitch fibers followed by carbonization and, additionally as needed, graphitization, the pitch fibers are subjected to infusiblization treatment following application of a dimethyl polysiloxane having a viscosity at 25° C. in the range between 0.5 and 500 cSt and removing said dimethyl polysiloxane by washing prior to the carbonization.

4 Claims, No Drawings

PROCESS FOR PRODUCING PITCH CARBON FIBERS

BACKGROUND OF THE INVENTION

The present invention relates to a process for producing pitch carbon fibers which are of excellent interfiber separability.

Pitch carbon fibers are produced by subjecting pitch fibers obtained by the melt spinning of a carbonaceous pitch to infusiblization and carbonization, and, additionally as needed, graphitization. The infusiblization treatment of pitch fibers, which is carried out usually at a temperature of 400° C. or below in the presence of an oxidative gas, is encountered with a problem for the pitch fibers to be adhered to each other during the infusiblization reaction. Moreover, in the subsequent carbonization step there also arises mutual adherence between the fibers though being to a slight extent. In either case, carbon fibers of good interfiber separability cannot be obtained from such mutually adhered fibers.

Heretofore, there is known an infusiblization treatment of pitch fibers following application of an oily agent, for example, technique to form pitch fiber tows by means of a water-soluble surface-active agent (Japanese Patent Publication No. 12740/1976). However, use of a water-soluble surface-active agent did reduce the interfiber separability in the infusibility treatment of fiber tows due to interaction between the surface-active agent and the fibers at higher temperatures although it improved tow formation of the fibers.

SUMMARY OF THE INVENTION

It is an object of the present invention to provide a process for producing carbon fibers of excellent interfiber separability by preventing mutual adherence of the fibers in the infusiblization step and the carbonization step.

Previously, we found that infusiblization treatment of pitch fibers following application to it of a specific compound having a structure within a scope and a viscosity within a range prevented mutual adherence of the pitch fibers based on which finding a patent application was filed (Japanese Patent Application No. 189240/1983).

As a result of extensive studies, we have now found that infusiblization treatment of pitch fibers following application to it of the above-mentioned specific compound (sometimes called "the oily agent for infusiblizatioh" herein below), subsequent removal of said compound by washing and then carbonization and, additionally as needed, graphitization produce carbon fibers of excellent interfiber separability.

We have further found that infusiblization treatment of pitch fibers following application to it of the above-mentioned specific compound, subsequent removal of said compound by washing and then carbonization following application of another compound having a structure within a scope and a viscosity within a range (sometimes called the "oily agent for carbonization" herein below) and, additionally as needed, graphitization produce carbon fibers of superior interfiber separability.

First, the present invention resides in a process for producing pitch carbon fibers wherein pitch fibers obtained by the melt spinning of a carbonaceous pitch are subjected to infusiblization and subsequent carbonization and, additionally as needed, graphitization which comprises applying to pitch fibers a dimethyl polysiloxane having a viscosity at 25° C. in the range between 0.5 and 500 cSt followed by infusiblization treatment, then removing by washing said dimethyl polysiloxane and then carbonizing and, additionally as needed, graphitizing the product.

Furthermore, the invention resides in a process for producing pitch carbon fibers wherein pitch fibers obtained by the melt spinning of a carbonaceous pitch are subjected to infusiblization and subsequent carbonization and, additionally as needed, graphitization which comprises applying to pitch fibers a dimethyl polysiloxane having a viscosity at 25° C. in the range between 0.5 and 500 cSt followed by infusiblization treatment, then removing by washing said dimethyl polysiloxane, applying to the infusiblized fibers a dimethyl polysiloxane having a viscosity at 25° C. in the range between 12,000 and 1,000,000 cSt and carbonizing and, additionally as needed, graphitizing the product.

DESCRIPTION OF THE PREFERRED EMBODIMENTS

Carbonaceous pitches which may be used in the present invention include coal pitches sucn as coal tar pitch and SRC, petroleum pitches such as ethylene tar pitch and decant oil pitch, and synthetic pitch, with petroleum pitches being particularly preferred.

Pitches obtained by modification of the above pitches are also included in the carbonaceous pitch referred to herein such as, for example, pitch which has been treated with a hydrogen donor such as tetralin, pitch which has been hydrogenated under a hydrogen pressure of 20–350 kg/cm$^2$, pitch which has been modified by heat treatment, and pitch which has been modified by a suitable combination of these methods. Thus, the carbonaceous pitch as used in the present invention is a general term for precursor pitches capable of forming pitch fibers.

The carbonaceous pitch used in the present invention may be an optically isotropic pitch, or it may be an optically anisotropic pitch. The optically anisotropic pitch is a pitch containing an optically anisotropic phase (so-called mesophase) obtained by heat-treating a pitch usually at 340°–450° C. while passing an inert gas such as nitrogen under atmospheric pressure or reduced pressure. Particularly preferred is the one having a mesophase content of 5 to 100%, preferably 60 to 100%.

It is preferable that the carbonaceous pitch used in the invention has a softening point of 240° to 400° C., more preferably 260° to 300° C.

Pitch fibers are obtained by melt-spinning the carbonaceous pitch by a known method, for example, by melting the carbonaceous pitch at a temperature by 30°–80° C. higher than its softening point, and extruding the melt through a nozzle 0.1–0.5 mm in diameter while taking up the resultant filaments at a velocity of 100–2,000 m/min to obtain pitch fibers.

To the fibers thus obtained is applied a dimethyl polysiloxane having a viscosity at 25° C. in the range between 0.5 and 500 cSt. The dimethyl polysiloxane referred to herein has the following structure:

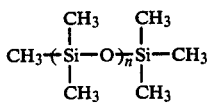

which has a viscosity at 25° C. preferably in the range between 1.0 and 100 cSt and more preferably between 1.0 and 25 cSt.

The viscosity of the dimethyl polysiloxane is very important in the present invention. If it is higher than the range specified above, the infusiblization reaction will be hindered, and the infusiblization rate will be reduced. On the other hand, if it is below the range specified above, the interfiber separability of the fibers after infusiblization will be reduced, that is, the object of the present invention cannot be attained.

The amount of the dimethyl polysiloxane applied is in the range between 0.01 and 50 wt. %, preferably between 0.1 and 25 wt. %, based on the weignt of the pitch fibers. The method of applying it to the fibers is not specifically limited. Known techniques such as the use of an oiling roller, external application, immersion and spraying can be utilized.

The pitch fibers are then subjected to infusiblization treatment under an oxidative gas atmosphere. The infusiblization treatment is carried out at a temperature usually not higher than 400° C., preferably 150°-380° C., more preferably 200°-350° C. If the treating temperature is too low, a longer treating time will be required, and if the treating temperature is too high, there will arise such a phenomenon as fusing or wastage. Therefore, both of such higher and lower temperatures are not desirable. As the oxidative gas, usually one or more of such oxidative gases as oxygen, ozone, air, nitrogen oxide, sulfurous acid gas and halogen are employed.

It is necessary in the present invent on that the fibers obtained by infusiblization treatment following application of a dimethyl polysiloxane having a viscosity at 25° C. in the range between 0.5 and 500 cSt which is used as an oily agent for infusiblization in the invention be washed prior to the carbonization treatment to remove said oily agent for infusiblization. Carbonization treatment with the oily agent for infusiblization as it is applied will not satisfactorily improve interfiber separability of the carbon fibers produced. It is believed that the poor improvement is due to degeneration of the above-mentioned dimethyl polysiloxane oily agent for infusiblization in the infusiblization step thereby producing adverse effects upon interfiber separability.

There is no particular limitation to the washing method to remove the dimethyl polysiloxane oily agent for infusiblization from the infusiblized fibers, but washing with an organic solvent is preferred. As the organic solvent may be employed any one which dissolves said dimethyl polysiloxane. Preferably used are aromatic hydrocarbons such as benzene, toluene and xylenes, aliphatic hydrocarbons such as n-hexane and n-heptane, ketones such as methyl ethyl ketone and methyl isobutyl ketone, ethers such as methyl cellosolve, ethyl cellosolve and ethyl ether, halogenated hydrocarbons such as carbon tetrachloride, trichloroethylene and methyl chloride and the like.

The infusiblized fibers obtained by the removal of the dimethyl polysiloxane oily agent for infusiblization by washing are then subjected to carbonization and, additionally as needed, graphitization treatments in the atmosphere of an inert gas to produce carbon fibers.

In the second aspect of the invention, the infusiblized fibers obtained as set forth above by the removal of the dimethyl polysiloxane by washing are additionally treated with a dimethyl polysiloxane having a viscosity at 25° C. in the range between 12,000 and 1,000,000 cSt, followed by carbonization and, additionally as needed, graphitization treatments to produce carbon fibers. When the carbonization and, additionally as needed, graphitization treatments are carried out under an inert gas atmosphere following application of the oily agent for carbonization, a dimethyl polysiloxane having a viscosity at 25° C. in the range between 12,000 and 1,000,000 cSt, interfiber separability of the carbon fibers obtained is much improved.

The amount of the dimethyl polysiloxane oily agent for carbonization is in the range from 0.5 to 30 wt. %, preferably from 2 to 20 wt. % on the basis of the weight of the infusiblized fibers. The method of applying it to the fibers is not specifically limited. Known techniques such as the use of an oiling roller, external application, immersion and spraying can be utilized.

In order to improve the working efficiency, in applying the dimethyl polysiloxane having a viscosity at 25° C. of 12,000 to 1,000,000 cSt to the infusiblized fibers it is preferably diluted with a suitable non-aqueous solvent, examples of which are aromatic hydrocarbons such as benzene, toluene and xylenes, aliphatic hydrocarbons such as n-hexane and n-heptane, ketones such as methyl ethyl ketone and methyl isobutyl ketone, ethers such as methyl cellosolve, dimethyl cellosolve and ethyl ether, and halogenated hydrocarbons such as carbon tetrachloride, trichloroethylene and methyl chloride, or a dimethyl polysiloxane of a low viscosity, e.g., preferably a viscosity at 25° C. of about 0.5 to 5 cSt.

The fibers with the dimethyl polysiloxane applied thereto are then subjected to carbonization and, additionally as needed, graphitization treatments. The carbonization treatment is carried out usually at a temperature of 800° to 2,000° C. The time required for the carbonization treatment is generally in the range of 0.1 minute to 10 hours. Subsequently, graphitization treatment is performed if necessary at a temperature of 2,000° to 3,500° C. usually for one second to one hour.

The following Examples and Comparative Examples are given to further illustrate the present invention, but it is to be understood that the invention is not limited thereto.

EXAMPLE 1

Petroleum precursor pitch having a mesophase content of 80 wt. % and a softening point of 280° C. was melt-spun to obtain pitch fibers having an average diameter of 13μ. To the pitch fibers was then applied 10 wt. % of a dimethyl polysiloxane having a viscosity at 25° C. of 10 cSt, followed by infusiblization treatment in an oxygen atmosphere in which the temperature was raised to 260° C. at a rate of 2° C./min.

After the infusiblization treatment, the dimethyl polysiloxane remaining in the infusiblized fibers was removed by washing with xylenes.

The washed infusiblized fibers were then heated in a nitrogen atmosphere to 850° C. at a rate of 5° C./min and maintained at that temperature for 5 minutes to produce carbon fibers. As shown in Table 1, interfiber separability of the carbon fibers thus obtained was good.

EXAMPLE 2

Carbon fibers were produced in the same way as in Example 1 except that the xylenes used therein were subjected with n-heptane. Results are shown in Table 1.

COMPARATIVE EXAMPLE 1

The pitch fibers as obtained in Example 1, without application of the dimethyl polysiloxane used in Example 2, were subjected to infusiblization treatment in the same way as in Example 1, followed by carbonization treatment carried out in the same way as in Example 1 to produce carbon fibers. As shown in Table 1, interfiber separability of the carbon fibers thus obtained was far inferior.

COMPARATIVE EXAMPLE 2

The infusiblized fibers as obtained in Example 1, without the removal of the remaining dimethyl polysiloxane by washing, were subjected to carbonization treatment carried out in the same way as in Example 1 to produce carbon fibers. As shown in Table 1, interfiber separability of the carbon fibers thus produced was inferior.

EXAMPLE 3

The infusiblized yarn as obtained in Example 1 with the removal of xylenes by washing applied to was then subjected to application of 10 wt. % or a dimethyl polysiloxane having a viscosity at 25° C. of 1,000,000 cSt. In order to increase operating efficiency of the application, the dimethyl polysiloxane was diluted with xylenes 4 times as much in volume.

The infusiblized fibers with the dimethyl polysiloxane oily agent for carbonization applied to were subjected to carbonization treatment in the same way as in Example 1 to produce carbon fibers. Results are shown in Table 1.

EXAMPLE 4

The infusiblized yarn as obtained in Example 2 with the removal of n-heptane by washing was subjected to application of the oily agent for carbonization in the same way as in Example 3, followed by carbonization treatment to produce carbon fibers. Results are shown in Table 1.

COMPARATIVE EXAMPLE 3

The infusiblized yarn as obtained in Example 1, without removal of the remaining dimethyl polysiloxane by washing, was subjected to application of the oily agent for carbonization, followed by carbonization treatment to produce carbon fibers. Results are shown in Table 1.

EXAMPLE 5

Petroleum precursor pitch having a content of the optically anisotropic phase of 90% and a softening point of 295° C. was melt-spun immediately followed by application of a dimethyl polysiloxane having a viscosity at 25° C. of 2 cSt to obtain pitch fibers having an average diameter of 13μ. The pitch fibers were subjected to infusiblization treatment in an oxygen atmosphere in which the temperature was raised to 260° C. at a rate of 2° C./min.

After the infusiblization treatment, the dimethyl polysiloxane remaining in the infusiblized fibers was removed by washing with methyl ethyl ketone.

Then, to the infusiblized yarn which nad been subjected to the removal by washing was applied 10 wt. % of dimethyl polysiloxane having a viscosity at 25° C. of 100,000 cSt. In order to increase operating efficiency of the application, the dimethyl polysiloxane was diluted with toluene 8 times as much in volume.

In infusiblized fibers with the dimethyl polysiloxane oily agent for carbonization were subjected to carbonization treatment in the same way as in Example 1 to produce carbon fibers. Results are shown in Table 1.

TABLE 1

| | Oily agent for infusiblization | Solvent to wash infusiblized yarn | Oily agent for carbonization | Interfiber separability |
|---|---|---|---|---|
| Example 1 | Dimethyl polysiloxane, 10 cSt | Xylenes | — | 44 |
| Example 2 | Dimethyl polysiloxane, 10 cSt | n-Heptane | — | 43 |
| Comparative Example 1 | — | — | — | 9 |
| Comparative Example 2 | Dimethyl polysiloxane, 10 cSt | (no washing) | — | 21 |
| Example 3 | Dimethyl polysiloxane, 10 cSt | Xylenes | Dimethyl polysiloxane, 1,000,000 cSt | 50 |
| Example 4 | Dimethyl polysiloxane, 10 cSt | n-Heptane | Dimethyl polysiloxane, 1,000,000 cSt | 50 |
| Comparative Example 3 | Dimethyl polysiloxane, 10 cSt | (no washing) | Dimethyl polysiloxane, 1,000,000 cSt | 36 |
| Example 5 | Dimethyl polysiloxane, 2 cSt | Methyl ethylketone | Dimethyl polysiloxane, 100,000 cSt | 50 |

In Table 1, Interfiber separability was evaluated by the following method:

A bundle of 50 carbonized fibers was cut to a length of 10 mm, which was then dropped slowly into a dish containing methanol in a depth of about 10 mm. Thereafter, evaluation was made in terms of the number of separated yarns. Number of the yarn was taken as 1 when two or more fibers were not separated but overlapped.

RESULTS OF THE INVENTION

As illustrated in the examples, there are produced carbon fibers of excellent interfiber separability by the use of the process according to the present invention.

We claim:

1. In the process for producing pitch carbon fibers by melt-spinning a carbonaceous pitch, and infusiblizing the resulting pitch fibers followed by carbonization and, additionally as needed, graphitization, the improvement which comprises subjecting the pitch fibers to infusiblization treatment following application of a dimethyl polysiloxane having a viscosity at 5° C. in the range between 0.5 and 500 cSt, then removing said dimethyl polysiloxane by washing, and subjecting the infusiblized fibers to application of a dimethyl polysiloxane having a viscosity at 25° C. in the range between 12,000 and 1,000,000 cSt prior to the carbonization.

2. Process according to claim 1 wherein the washing of the dimethyl polysiloxane is carried out by the use of an organic solvent.

3. Process according to claim 1 wherein the amount of the applied dimethyl polysiloxane at the first stage is in the range between 0.01 and 50% by weight on the basis of the pitch fibers and the amount of the applied dimethyl polysiloxane at the second stage is in the range between 0.5 and 30% by weight on the basis of the infusiblized fibers.

4. Process according to claim 1 wherein the second-stage dimethyl polysiloxane is applied in the form of a solution in a non-aqueous solvent.

* * * * *

UNITED STATES PATENT AND TRADEMARK OFFICE

CERTIFICATE OF CORRECTION

PATENT NO. : 4,656,022

DATED : April 7, 1987

INVENTOR(S) : Seiichi Uemura, et al.

It is certified that error appears in the above-identified patent and that said Letters Patent is hereby corrected as shown below:

Column 6, line 50, Claim 1: "5°C." should be

--25°C.--

Signed and Sealed this

Twenty-fifth Day of August, 1987

*Attest:*

DONALD J. QUIGG

*Attesting Officer*

*Commissioner of Patents and Trademarks*